US005635801A

United States Patent [19]

Regazzi et al.

[11] Patent Number: 5,635,801

[45] Date of Patent: Jun. 3, 1997

[54] CAPACITIVE-DISCHARGE IGNITION SYSTEM FOR INTERNAL-COMBUSTION ENGINES

[75] Inventors: Gianni Regazzi; Beniamino Baldoni, both of Bologna, Italy

[73] Assignee: Ducati Energia S.p.A., Bologna, Italy

[21] Appl. No.: 508,524

[22] Filed: Jul. 28, 1995

[30] Foreign Application Priority Data

Jul. 29, 1994 [IT] Italy ..... MI94A1663

[51] Int. Cl.[6] ..... H05B 37/02

[52] U.S. Cl. ..... 315/209 CD; 123/605

[58] Field of Search ..... 123/601, 605; 315/209 CD, 276

[56] References Cited

U.S. PATENT DOCUMENTS

| | | | |
|---|---|---|---|
| 4,537,174 | 8/1985 | Nagasawa | 123/604 |
| 4,636,671 | 1/1987 | Terada | 310/74 |
| 5,072,714 | 12/1991 | Bengtsson | 123/601 |

FOREIGN PATENT DOCUMENTS 0 601 460 6/1994 European Pat. Off. .

*Primary Examiner*—Robert Pascal

*Assistant Examiner*—Michael Shingleton

*Attorney, Agent, or Firm*—Young & Thompson

[57] ABSTRACT

A capacitive-discharge ignition system for internal-combustion engines; the system comprises a magneto generator having a rotor provided with a plurality of magnets angularly spaced on an inner peripheral surface, in which at least two adjacent magnets have a pole of the same polarity facing a stator core having a plurality of radially extending pole members; a voltage generating winding on said pole members comprises first and second coils serially connected and wound onto adjacent pole member of the stator core to supply charging voltage to the ignition circuit and a control voltage for triggering an ignition signal generating circuit. A negative voltage is detected at each revolution of the magneto generator from an intermediate output point generator of the serially connected coils and a reference point of a voltage divider and fed through electronic control switch means to activate an electronic control switch for triggering the ignition circuit.

16 Claims, 3 Drawing Sheets

CAPACITIVE-DISCHARGE IGNITION SYSTEM FOR INTERNAL-COMBUSTION ENGINES

BACKGROUND OF THE INVENTION

1. Field of the Invention

The present invention relates to a capacitive-discharge ignition system for internal-combustion engines, comprising an improved construction of a magneto generator, in combination with a control voltage circuit for feeding and triggering the discharge of the ignition capacitor, by means of which it is possible to optimize the capacitor charging voltage, and a single ignition trigger pulse for each revolution of the magneto generator, avoiding the use of any additional trigger coil inside or outside the same generator.

2. Description of the Related Art

The capacitive-discharge ignition systems for motor cycles and the like are formed mainly by a multipolar electric generator, normally of magneto type, which in addition to supplying the energy necessary for the low-voltage loads of the motor-cycle, via a suitable additional winding, also provides the energy for charging the ignition capacitor. A pick-up or a timing sensor coil is normally provided inside or outside the magneto generator in order to generate a control signal for triggering the ignition circuit at each revolution of the engine.

The most common capacitive-discharge ignition circuits usually comprises a winding consisting of one or more serially-connected stator coils for supplying the necessary voltage for charging an ignition capacitor. Normally the coils consist of a very high number of turns of thin wire, for example from three to four thousand turns of a wire of 0.1 to 0.15 mm diameter, necessary for bringing the ignition capacitor to a charging voltage ranging between 100 and 300 Volts. During revolution of the rotor on which permanent magnets are provided, an alternating voltage is induced in the stator coils, the positive going half-cycle outputs of which directly biases some diodes connected in series to the capacitor circuit, charging the latter to the desired voltage. When a pulse in timing relation with the engine cycle is generated by an additional coil, an electronic switch arranged in the ignition-capacitor discharge circuit is activated; the energy at the voltage to which the ignition capacitor was previously charged is then discharged onto the primary winding of the ignition coil, generating on the secondary winding a high voltage which causes an electric spark in the spark-plug of the ignition circuit. The solution described above, although most commonly used, has, however, two basic drawbacks:

- a non-optimum trend of the ignition-capacitor charging voltage, which tends to have a bell-shaped curve, having a high maximum value substantially influenced by the rotational speed of the engine;
- the presence of a separate coil for generation of the trigger signal, inside or outside the generator, for the ignition command. The use of a separate coil for generation of the ignition trigger signal is inconvenient in many applications since any appropriate positioning of the pick-up or timing coil is very difficult due to the small overall dimensions which are generally required for these types of ignition systems.

The first drawback can be overcome by using, for example, a capacitor charging system which employs a voltage booster as described in a previous patent application, IT-MI92A002809, in the name of the same Applicant.

Solutions also exist for the second drawback as well, although they are not considered to be optimal. The most widely adopted solution is undoubtedly that shown in FIG. 1 of the accompanying drawings, which envisages the use of capacitive-discharge system combined with a generator 10 comprising a stator winding L1 and a four-pole rotor 11, as schematically shown.

As can be seen from the same FIG. 1, this solution does not require the use of any additional winding for generation of the timing signal, but it is the same ignition feed winding L1 which, in addition to charging the capacitor C by means of the diode D1 via the positive half-waves generated by L1, together with the negative half-waves, triggers an electronic switch SCR in the discharge circuit of the capacitor C comprising the primary winding Lp of the high-voltage coil, the secondary winding Ls of which is connected to the spark-plug CD. A diode D4 is connected in parallel to the primary winding Lp of the high-voltage coil, while a diode D2 and biasing resistor R1 are connected in parallel between the control electrode of the SCR switch and the outlet side of the winding L1 via a biased diode D3.

During the positive half-waves, D1, D2 and D4 are forward biased and hence the capacitor C is able to be charged while the SCR is inhibited and no current is flowing in R1, since D3 being inversely biased.

When the voltage generated by L1 becomes negative, then D3 is forward biased and, via the biasing resistor R1, the control electrode of the SCR is biased directly, being triggered, this in turn permitting discharging of the capacitor C onto the primary winding Lp and onto the high-voltage coil generating the spark in the spark-plug CD.

This solution is applicable, however, only in normal four-pole generators where two sparks phase-displaced by 180° with respect to each other are generated for each revolution. Since this ignition is generally used on single-cylinder engines, which require an ignition spark for each cycle, it occurs that one of the two generated sparks, although being uninfluential on operation of the engine, nevertheless contributes to an undue power consumption and an increase of the temperature of the ignition circuit.

There exist other solutions which use multipolar magneto generators without a separate trigger coil which, combined with the circuit in FIG. 3, are able to generate a single spark per revolution, as for example shown and described in U.S. Pat. No. 4,636,671.

According to this solution, the rotor has a certain number of radially magnetized magnets circumferentially arranged adjacent to one another and having a pole of the same North or South polarity facing towards the stator coils, while remaining magnets have the usual alternation of their North and South polarities.

The stator of this generator has, moreover, a large pole shoe for the capacitor charging coil, which is of greater dimensions than the pole shoes of the remaining poles thus involving additional operations for the stator and separate winding of the coils.

As can be better seen from FIG. 5 of U.S. Pat. No. 4,636,671, the pole shoe of the capacitor charging coil has a circumferential extension greater than the single magnets, so that it short-circuits the magnetic flux between adjacent magnets when the latter have opposite polarities.

Therefore, according to this prior art solution, only in the case of adjacent poles having the same polarity is the flux able to pass through the magnetic pole shoe of the capacitor charging coil and hence the latter generate a voltage signal as shown in the same FIG. 6, this signal being compatible with the electronic ignition circuit shown in FIG. 1, thus generating a single spark per revolution of the engine.

The drawback of this solution, mainly resides in that the charging of the ignition capacitor cannot be optimized because during a 360° revolution, a single positive half-wave (30° in the case of a 12-poles generator) is disposable for charging the capacitor and for ignition purpose.

In addition to this drawback, by having a stator pole shoe of larger dimension, which is so different from the others, involves further problems as regards execution or the winding of the coils.

U.S. Pat. No. 4,537,174 also describes a 12-poles magneto generator in which the capacitor charging coils are wound onto two adjacent pole shoes of identical angular width and in which a cup-shaped rotor comprises a ring shaped main magnet magnetized to provide a plurality of alternate North and South poles which are arranged in succession along the entire inner surface of the circular side wall of the rotor; in this generator use is made also of a pick-up coil to generate the timing signal for triggering the ignition capacitor, which pick-up coil is positioned outside the generator, with the consequent disadvantages and drawbacks referred to above.

At present U.S. Pat. No. 4,636,671 represents the closest prior art on which the innovative features of the invention can be defined.

SUMMARY OF THE INVENTION

The object of the present invention is therefore to provide a capacitive-discharge ignition system for internal-combustion engines, which makes use of a multipolar magneto generator in which the conventional separate pick-up or timing coil for generating the discharge trigger signal is completely eliminated and in which in addition to providing a single spark per revolution thus reducing the thermal stresses, and also enabling the charging of the ignition capacitor to be optimized, by using more positive half-waves per revolution, having stator pole shoes of substantially the same dimensions.

The ignition system according to the invention comprises a stator winding for charging the ignition capacitor and for generating a timing signal per revolution, said stator winding comprising at least first and second serially connected coils wound in mutually opposite directions onto adjacent magnetic pole members of a stator core and in which an intermediate voltage outlet point between said coils is in turn connected to a control electrode of an electronic switch provided in the discharging circuit of the capacitor, via an auxiliary electronic control switch activated by a negative voltage signal from said intermediate voltage outlet point of said two coils, under the control of a peak detector connected between said intermediate voltage outlet point X of capacitor charging coils and an intermediate voltage reference point Y of a unidirectional voltage divider parallely connected to said capacitor charging coils.

BRIEF DESCRIPTION OF THE DRAWINGS

The invention will now be described in greater detail hereinbelow with reference to the accompanying drawings, in which.

DESCRIPTION OF THE PREFERRED EMBODIMENT

Figure 1:
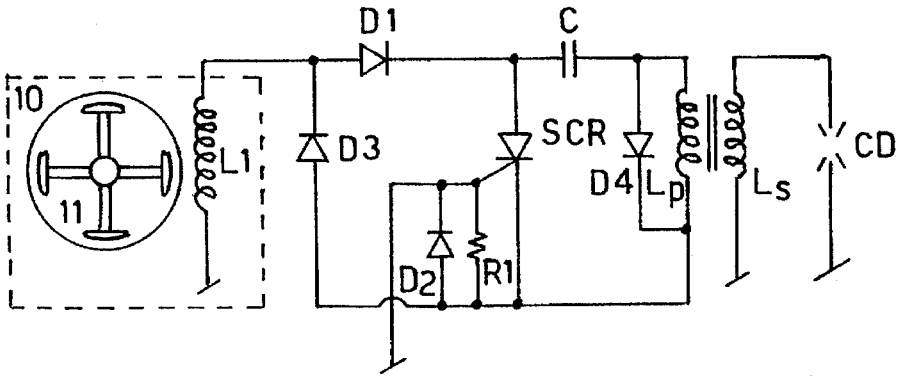
FIG. 1 is the electrical diagram of a conventional ignition system.

The invention will be described hereinbelow with reference to FIGS. 2 to 9 which show a preferred embodiment, FIG. 1 not being described again since it relates to an ignition circuit known per se.

Figure 2:
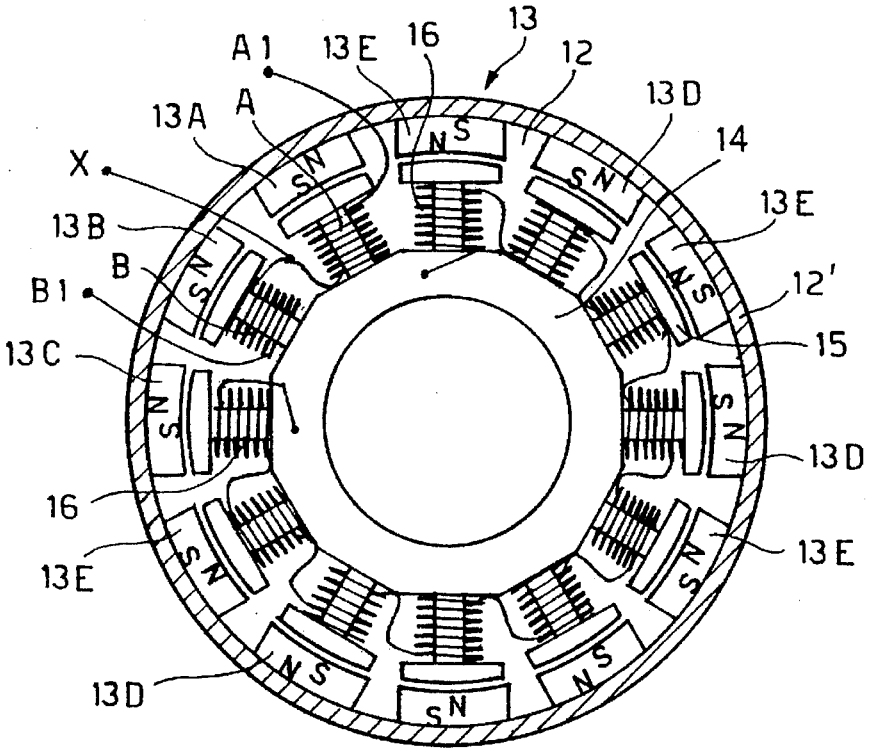
FIG. 2 is a cross-sectional view showing a magneto generator according to the invention, in a first operative condition.

FIG. 2 shows a magneto generator according to the invention, of the 12-poles type; the generator comprises a cup-shaped rotor 12 made of magnetic material, for example iron, comprising a plurality of permanent magnets 13, for example twelve, fixed internally to the circular side wall 14 of the rotor, at equally spaced angular intervals. Since twelve magnets have been provided, as shown, the angular pitch between adjacent magnets is therefore 30°. Each magnet 13 is magnetized in the radial direction to have their polarities facing towards the coil winding of an internal stator, in the manner shown. More precisely, according to the present invention, three adjacent magnets 13A, 13B and 13C have poles with a same polarity S all facing in the radial direction towards the coil winding of a stator core 14, inside the rotor 12, while the remaining magnets indicated alternately with 13D and 13E have North and South poles, i.e. of opposite polarities, normally alternating with one another, as shown.

In FIG. 2, 14 denotes the stator core of the generator, made of ferro-magnetic material, which is provided with twelve pole members 15 circumferentially arranged on the core 14, said pole member 15 being spaced apart with the same polar pitch as the magnets 13 and ending in an enlarged T-shaped pole shoe having a circumferential width equal to or slightly less than the circumferential width of the magnets 13.

As shown in the same figure, ten pole shoes 13C, 13D and 13E have wound on them in mutually opposed directions the same number of low-voltage coils 16 serially connected with each other for powering the electrical loads of a vehicle, while the remaining two pole shoes opposite magnets 13A and 13B have wound on them two coils A and B intended solely for feeding and controlling the ignition system, as shown.

More precisely, the two coils A and B are connected in series with one another, have the same number of turns and are wound in opposite directions so as to generate two alternating voltages $V_A$ and $V_B$ of the same value in phase with one another, which can be added together.

The coils A and B have moreover output end A1 and B1 as well as an intermediate connection point X between them.

Figure 3:
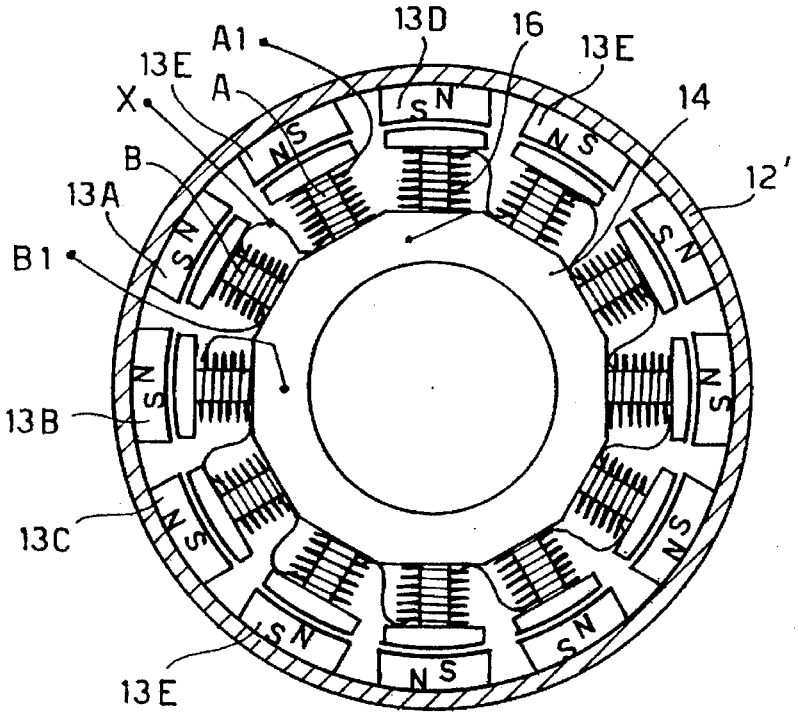
FIG. 3 is a cross-sectional view similar to that of the preceding figure, showing the magneto generator in a second operative condition, with the rotor moved by one pole pitch.

FIG. 3 of the drawings shows a view of the generator similar to that of FIG. 2, in which the cup-shaped rotor 12 is now forward rotated, in an anti-clockwise direction, by one pole pitch, i.e. 30°, with respect to the stator 14; as regards the remainder, FIG. 3 corresponds exactly to FIG. 2.

Figure 4:
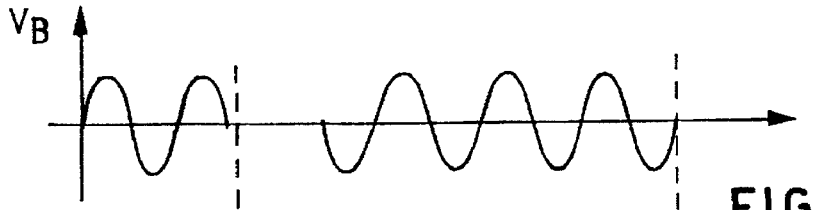
FIG. 4 is a diagram showing the voltage generated by one of the coils of the capacitor charging winding.
Figure 5:
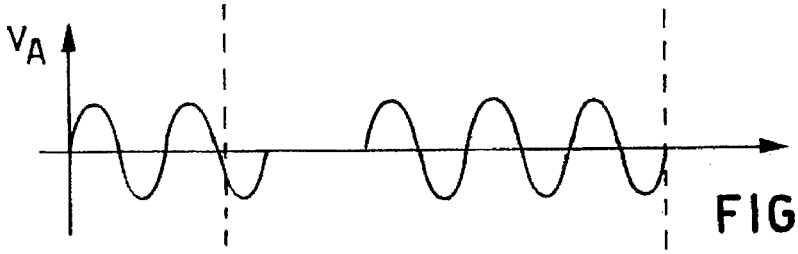
FIG. 5 shows the voltage generated by the other coil of the capacitor charging winding.
Figure 7:
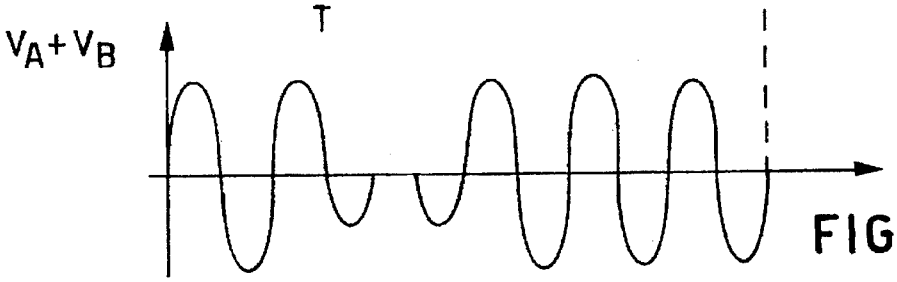
FIG. 7 shows the sum of the voltages generated by both the capacitor charging coils.

FIGS. 4 and 5 show the waveform for the alternating voltages $V_A$ and $V_B$ generated by each individual coil A and B, while FIG. 7 shows the voltage $V_A+V_B$, being the sum of the former.

As can be noted, each of the ignition feed coils A and B generates an alternating voltage which is made null when there is no flux variation, in particular when each of said coil passes between adjacent magnets with the same polarity facing towards the stator core.

Since the two feed coils A and B are adjacent to one another, angularly spaced by one pole pitch, wound in the opposite direction with respect to one another and connected in series, the resulting voltages $V_A$ and $V_B$, although being equal and in phase with one another, have zero-voltage zones of length equal to one double pole pitch, but displaced with respect to each other by 30°, i.e. one pole pitch only.

It follows that the voltage $V_A+V_B$ resulting from sum of the two voltages $V_A$ and $V_B$ is in phase with the latters and will have a zero-voltage zone of length equal to one pole pitch only.

Figure 8:
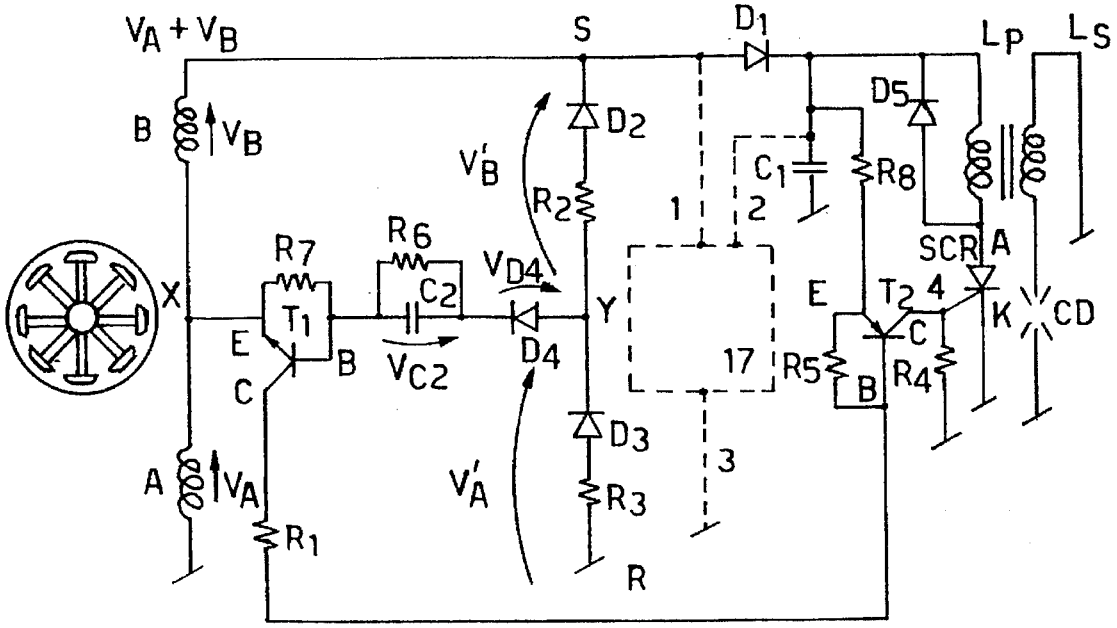
FIG. 8 is a diagram of the entire ignition system, according to the invention.

With reference now to FIGS. 4 to 7 again and FIG. 8, we shall describe the ignition circuit and its mode of operation, according to the present invention.

In FIG. 8, reference 12 schematically indicates the magnetic rotor, while A and B indicate again the two ignition feed coils which, as mentioned previously, are identical to one another, have the same number of turns and are wound in opposite directions on two adjacent magnetic pole member of the rotor core. The outlet A1 of the coil A1 is connected to earth or defines the negative terminal, while the other outlet B1 of the coil B is connected to the positive terminal of the ignition capacitor C1 via a diode D1.

In FIG. 8, moreover, Lp and Ls indicate the primary winding and the secondary winding of a high-voltage spark coil which feeds the spark-plug CD, in which the primary winding Lp is connected in series to a discharging circuit for the capacitor C1, comprising an electronically controlled switch SCR as shown. D5 denotes a diode for recirculation of the current into Lp, while R4 denotes the biasing resistor for the control electrode G of the SCR thyristor or other equivalent electronic switch for triggering discharging of the capacitor C1.

Still with reference to FIG. 8, the circuit comprises an electronic switch T2 to activate the capacitor discharging switch SCR in which the same T2 is activated by an auxiliary electronic switch T1 under the control of a peak detector; the peak detector comprises a capacitor C2 and a resistor R6 arranged in parallel with the latter which, together with a reverse-biased diode DA and a biasing resistor R7 on the base of T1, form a control circuit branched-off between the intermediate voltage output point X between the coils A and B, and an intermediate point Y of a unidirectional voltage divider, consisting of the resistor R2 and the diode D2, in series with the resistor R3 and the diode D3, connected in parallel to the aforementioned coils A and B; overall A, B, R2 and R3 define a kind of bridge circuit, in which T1 and the peak detector are arranged in the main branch so as to be activated when the bridge is unbalanced as the result of a negative voltage on the coil A connected to the negative terminal, while the voltage on the coil B connected to the positive terminal, or to C1, is zero.

More precisely, the electronic control switch T1 in the example shown consists of an NPN transistor with a biasing resistor R7 between the base B and the emitter E, while the collector C is connected, via a resistor R1, to the base B of the electronic control switch T2, in turn consisting of a PNP transistor having the collector C connected to the control electrode G of the SCR, and the emitter E connected to a positive voltage source, for example to the positive side of the ignition capacitor C1 via the resistor R8; R5 denotes moreover the biasing resistor of T2.

In FIG. 8, finally, reference 17 denotes a voltage booster circuit for optimizing charging of the capacitor C1, shown in detail in the diagram of FIG. 9, described below.

Operation of the circuit shown in FIG. 8 is as follows: the ignition feed coils A and B, as mentioned previously, supply two alternating voltages $V_A$ and $V_B$ in phase and equal to one another, except when one of the coils passes from a magnet 13A with a polarity S to a next magnet 13B having the same polarity S, while the other coil B passes from a magnet 13C again having the same polarity S to a next magnet 13D having a polarity N which is opposite to the former.

In the first case there is no generation of voltage since there is no variation in magnetic flux, while in the second case there is voltage generation in the coils A and B.

Therefore, when the summed voltage $V_A+V_B$ (FIG. 7) is positive, then the coils A and B will charge the ignition capacitor C1 via the diode D1.

During this step, the SCR or other equivalent switch for triggering the discharge of C1 cannot be actuated or switched-ON, remaining inhibited, since, with the diodes D2 and D3 of the voltage divider are biased in the reverse direction, and no current will flow through the voltage divider so that the voltage at reference point Y will be 0, or negative with respect to the voltage at the point X, preventing D4 to pass any current of the peak detector and the electronic control switch T1.

The electronic switch T1 will therefore be inhibited in the same manner as the electronic switch T2.

When the voltage $V_A$ is equal to $V_B$ and both are negative, and since the resistors R2 and R3 are equal to one another, as will also be the voltage drops on the diodes D2 and D3, the result will be that the voltage $V_A'$ on R3 and D3 will be equal to the voltage $V_B'$, on R2 and D2, in turn equal to the voltages $V_A$ and $V_B$; therefore, between the points X and Y of the branched-off timing signal generating circuit T1, R7, R6, C2 and D4 there will be no voltage difference and the control switch T1 will also be inhibited in this case, as will the switch T2 controlling the SCR switch for discharging the capacitor C1.

Similarly, when $V_A$ is equal to 0 and $V_B$ is negative, diode D4 will be reverse biased and the switch T1 will again be inhibited, in the same manner as the switch T2 and the SCR switch.

Figure 6:
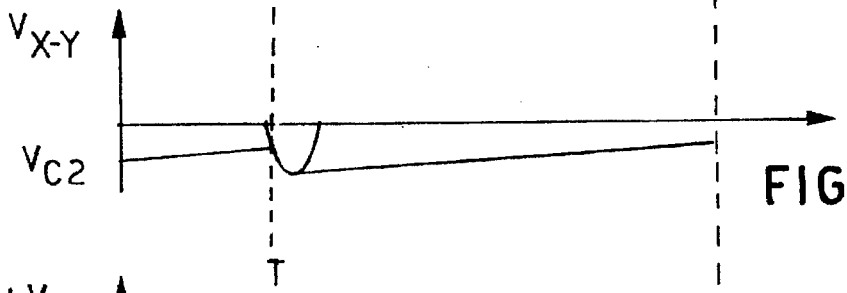
FIG. 6 shows the voltage of the peak detector, for generation of the discharge trigger signal.

The only unbalanced condition for the bridge, which will allow activation of the SCR, as shown in FIG. 6, and hence of the capacitor C1 and triggering the spark in the ignition spark-plug CD, consists of the time T in FIG. 6, in which $V_B$ is equal to zero, while $V_A$ is negative, so that the diodes D2, D3 and D4 are all conducting with the voltage of the point Y greater than the voltage at the point X.

The assembly D4, C2 and R6, shown in FIG. 8, constitutes an optional peak detector which serves to avoid any false triggering of the SCR switch due to possible magnetic differences in the circuits of the coils A and B or due to any tolerances of the resistors R2 and R3.

Therefore, when the voltage difference between the aforementioned points Y and X is greater than the sum of the voltages $V_{D4}+V_{C2}+V_{BE}$ relating to the voltage drop on D4, on C2 and between base B and emitter E of T1, then T1 will start to conduct and, via the current-limiting resistor R1, will bias the base of the PNP-type transistor T2 which, having its emitter E connected to a positive voltage source, will in turn bias the control electrode G of the SCR, causing it to conduct.

In these conditions, the ignition capacitor C1 can be discharged onto the primary winding Lp of the high-voltage coil which will generate on the secondary winding Ls a high voltage capable of triggering a spark in ignition spark-plug CD.

When C1 is discharged, the current flowing in Lp will flow in a closed circuit comprising the recirculation diode D5.

As previously mentioned, FIG. 8 illustrates also the possible use of a voltage booster 17 which, although not being indispensable, nevertheless permits an efficient charging of C1.

A possible solution of the voltage booster circuit 17 is shown schematically in FIG. 9 which will be described hereinbelow for the purposes of a complete illustration.

Figure 9:
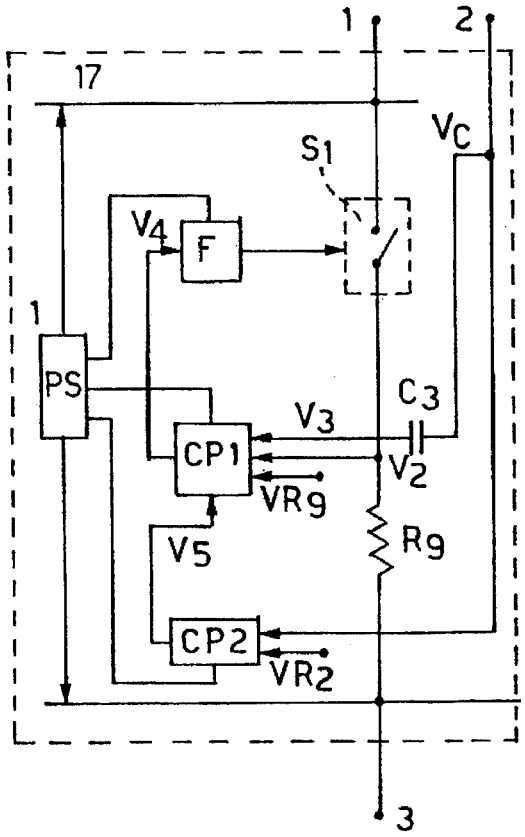
FIG. 9 is a detail of a voltage booster circuit which can be used with the ignition circuit of the preceding figure, in order to optimize the charging of the ignition capacitor.

The circuit in FIG. 9 is connected to the ignition-capacitor charging circuit at the points 1, 2 and 3 indicated in the same figures.

In particular, the circuit of FIG. 9 comprises an electronic switch S1 and a resistor R9 or other equivalent circuit means for supplying at an input of a first voltage comparator CP1, a voltage V2 which is proportional to the current flowing through the electronic switch S1, in order to control, by means of the output voltage V4 applied to the input side of an interface F, rapidly repeated opening and closing operations of the same switch S1. In fact, rapidly repeating opening and closing of the switch S1 enables boosting of the output voltage of coils A and B, and charging of the capacitor C1 to a substantially constant voltage value, independently of the output voltage of the electric generator and the operating condition of the engine. Opening and closing of the switch S1 is controlled by the voltage comparator CP1 which is supplied at its input side with the voltage V2, indicating the current value flowing through the switch S1, with a voltage V3 provided by a capacitor C3 supplied with the voltage VC of the capacitor C1, in order to maintain a first operational state of the comparator CP1, or by any other device able to provide a derived function of the increase in the voltage of the ignition capacitor C1 during each charging operation of the same capacitor, as well as with a reference voltage VR9 indicating the maximum level of the voltage allowed for V2 and hence the maximum current of the switch S1 with respect to which the comparator CP1 actuates the opening and closing in rapid succession of said switch.

CP2 in FIG. 9 denotes moreover a device for inhibiting CP1, designed to define the maximum level of the voltage VC of the capacitor C1, and to provide a second reference voltage VR2 for preventing operation of CP1 and keeping S1 open, when VC reaches or tends to exceed the maximum permissible level for the ignition-capacitor charging voltage.

Therefore, the output V5 of CP2 is sent to a control input of CP1 for the aforementioned purpose. Finally, PS schematically represents a supply circuit for the various functional units of the system.

From the above description and illustration with reference to the accompanying drawings it is therefore understood that the present invention provides a novel solution by means of which it is possible to obtain, without a separate coil for triggering discharging of the capacitor, a single spark per revolution, providing at the same time a greater number of pulses for charging the ignition capacitor.

It is therefore understood that the above description and illustration with reference to the accompanying drawings have been provided solely by way of explanation: for example the electronic switches T1 and T2 could be formed, in addition to NPN and PNP transistors, with N-channel MOS transistors or P-channel MOS transistors, without thereby departing from the innovative principles of the invention claimed.

What is claimed is:

1. A capacitive-discharge ignition system for an internal combustion engine comprising:

a voltage generator having a power output;

an ignition circuit having a capacitor for storing electrical energy, and switch means for operationally connecting said capacitor to the power output of the voltage generator, and to a sparking circuit of the engine; said voltage generator comprising:

a cup shaped rotor of magnetic material having a cylindrical side wall, and plurality of magnets circumferentially arranged at equal intervals and radially protruding from said cylindrical wall of the rotor to provide inwardly facing pole faces; said plurality of magnets comprising a first group of at least two magnets having pole faces of a same polarity extending over a first portion of said cylindrical wall, said plurality of magnets also comprising a second group of magnets having pole faces of opposite polarities alternatively extending over remaining portion of said cylindrical wall;

a stator core within said cup-shaped rotor, said stator core comprising a plurality of pole-members circumferentially arranged at equal intervals and radially protruding towards said pole-faces of the magnets on said cylindrical wall of the rotor, each of said pole-members having a coil wound around thereof; the coils of said pole-members defining a first set of at least two serially connected and electrically in phase coils wound on adjacent pole-members of the stator, as well as a second set of serially connected coils wound in mutually opposed directions on remaining pole members of the rotor; and voltage activated circuit means connected to an intermediate point between said first set of coils to provide a spark control signal during each revolution of the voltage generator.

2. A capacitive-discharge ignition system according to claim 1, wherein said voltage activated circuit means comprises a peak detector connected to a control electrode of a first auxiliary control switch, said first auxiliary control switch being connected to an intermediate point of a voltage divider by a serially connected and reverse biased diode, said voltage divider being connected in parallel to said first set of coils.

3. A capacitive-discharge ignition system according to claim 2, wherein said first set of coils have a same number of turns, and wherein said voltage divider comprises a first and a second resistor of substantially identical value, and serially connected diodes biased in a same direction.

4. A capacitive-discharge ignition system according to claim 3, wherein said first resistor and said second resistor of the voltage divider each provides a voltage drop substantially corresponding to a voltage generated by each coil of said first set of coils.

5. A capacitive-discharge ignition system according to claim 2, wherein said first set of coils and said voltage divider define a bridge circuit, and wherein said first auxiliary control switch is connected in said voltage activated circuit means between an intermediate point of said first set of coils and the intermediate point of said voltage divider.

6. A capacitive-discharge ignition system according to claim 1, further comprising a voltage boosting circuit connected in parallel to said first set of coils.

7. A capacitive-discharge ignition system according to claim 1, wherein each coil of said first set of said coils is wound onto pole members of the stator core extending over angular width at most equal to an angular width separating each of said plurality of magnets provided inside the cup shaped rotor.

8. A capacitive-discharge ignition system for an internal combustion engine comprising:

a voltage generator having a power output;

an ignition circuit having a capacitor for storing electrical energy, and switch means for operationally connecting said capacitor to the power output of the voltage generator, and to a sparking circuit of the engine; said voltage generator comprising:

a cup shaped rotor of magnetic material having a cylindrical side wall, and plurality of magnets circumferentially arranged at equal intervals and radially protruding from said cylindrical wall of the rotor to provide inwardly facing pole faces; said plurality of magnets comprising a first group of at least two magnets having pole faces of a same polarity extending over a first portion of said cylindrical wall, said plurality of magnets also comprising a second group of magnets having pole faces of opposite polarities alternatively extending over remaining portion of said cylindrical wall;

a stator core within said cup-shaped rotor, said stator core comprising a plurality of pole-members circumferentially arranged at equal intervals and radially protruding towards pole-faces of the magnets on said cylindrical wall of the rotor, each of said pole-members having a coil wound around thereof; the coils of said pole-members defining a first set of at least two serially connected and electrically in phase coils wound on adjacent pole-members of the stator, as well as a second set of serially connected coils wound in mutually opposed directions on remaining pole members of the rotor; and voltage activated circuit means connected to an intermediate point between said first set of coils and to an intermediate point of a voltage divider connected in parallel to said first set of coils, to provide a spark control signal during each revolution of the voltage generator.

9. A capacitive-discharge ignition system according to claim 8, wherein said voltage activated circuit means comprises a peak detector connected to a control electrode of a first auxiliary control switch, said first auxiliary control switch being connected to said intermediate point of said voltage divider by a serially connected and reversed biased diode.

10. A capacitive discharge ignition system according to claim 9, wherein said first set of coils have a same number of turns, and wherein said voltage divider comprises a first and a second resistor of substantially identical value, and serially connected diodes biased in a same direction.

11. A capacitive discharge ignition system according to claim 10, wherein said first resistor and said second resistor of the voltage divider each provides a voltage drop substantially corresponding to a voltage generated by each coil of said first set of coils.

12. A capacitive-discharge ignition system according to claim 9, wherein said first set of coils and said voltage divider define a bridge circuit, and wherein said first auxiliary control switch is connected in said voltage activated circuit means between the intermediate point of said first set of coils and the intermediate point of said voltage divider.

13. A capacitive-discharge ignition system according to claim 8, further comprising a voltage boosting circuit connected in parallel to said first set of coils.

14. A capacitive-discharge ignition system according to claim 8, wherein each coil of said first set of coils is wound onto a respective pole member of the stator core extending over an angular width at most equal to an angular width separating each of said plurality of magnets provided inside said cup-shaped rotor.

15. A capacitive-discharge ignition system according to claim 2, wherein said voltage divider is a unidirectional voltage divider.

16. A capacitive-discharge ignition system according to claim 8, wherein said voltage divider is a unidirectional voltage divider.

* * * * *